United States Patent [19]

Filby

[11] Patent Number: 4,639,989

[45] Date of Patent: Feb. 3, 1987

[54] SANDING TOOL

[76] Inventor: Charles E. Filby, 73 Bank Ave., Winnipeg, Manitoba, Canada, R2M 0N3

[21] Appl. No.: 721,442

[22] Filed: Apr. 9, 1985

[30] Foreign Application Priority Data

Oct. 2, 1984 [CA] Canada ..... 464565

[51] Int. Cl.[4] ..... B23D 71/00

[52] U.S. Cl. ..... 29/79

[58] Field of Search ..... 29/79, 78, 80

[56] References Cited

U.S. PATENT DOCUMENTS

| | | | |
|---|---|---|---|
| 2,549,570 | 4/1951 | Bryan | 29/79 |
| 3,050,827 | 8/1962 | Davies | 29/78 |
| 3,623,200 | 11/1971 | Curcio | 29/78 |

FOREIGN PATENT DOCUMENTS

| | | | |
|---|---|---|---|
| 174200 | 8/1952 | Austria | 29/79 |
| 886383 | 8/1953 | Fed. Rep. of Germany . | |
| 1577584 | 3/1977 | Fed. Rep. of Germany . | |
| 538474 | 3/1972 | France | 29/80 |
| 172899 | 12/1921 | United Kingdom | 29/79 |
| 442354 | 2/1936 | United Kingdom | 29/80 |
| 663580 | 12/1951 | United Kingdom . | |

*Primary Examiner*—Leonidas Vlachos

*Attorney, Agent, or Firm*—Stanley G. Ade

[57] ABSTRACT

A sanding tool comprises a plurality of saw blades arranged in spaced relation projecting from a planar surface of a rigid plastics supporting member a distance of the order of ⅛ inch. The spacing of the blades is very much wider than the width of the blade to provide a self-cleaning effect and the plastics member provides a shoulder alongside each of the outermost blades so that the shoulders prevent gouging of the blades.

2 Claims, 6 Drawing Figures

SANDING TOOL

BACKGROUND OF THE INVENTION

This invention relates to a sanding tool which is particularly but not exclusively designed for use with a settible filler material for example in body repair work on motor vehicles.

In body repair work, in order to obtain a smooth surface for finishing, any dents or depressions are filled with a settible body filler which is usually a mixture of a filling material and a hardener whereby the material sets hard after a predetermined period of time generally in the order of 5 to 10 minutes. For many years the conventional technique for finishing this material after it has been spread into the depression or dent has employed initially a cheese-grater device which shaves off an upper layer of the material so as to shape it initially generally to the required contours. The cheese-grater device can only be used on the material while it is hardening and hence is in a semi-moist state. Subsequent to the initial shaping, the material is sanded using generally 40 grade sandpaper which smooths the repair down to a smooth and properly contoured shape for painting and finishing. The painting and finishing steps often involve a first layer of primer followed by a putty glaze which is then sanded to remove any scratch marks from the initial rough sanding of the filler material. Finally the finished repair is painted using conventional techniques.

The sandpaper must be continually replaced since it tends to clog with the removed material and of course it rapidly wears. Large quantities of sandpaper are therefore consumed in a commercial process where body repair is carried out on a regular basis. Furthermore the sandpaper has a number of problems in that it develops dust which fills the atmosphere and of course is unsatisfactory from an health and environment point of view. In addition, the sandpaper can only be used when the filler material has effectively set hard since otherwise it rapidly clogs and becomes ineffective after a few strokes. This is disadvantageous because it creates the dust and in addition the material is much more difficult to work.

Despite the large expense of the continual replacement of sandpaper and the many disadvantages of this technique, this has been the only method available for body repair work and has been used exclusively for many years without the devlopment of suitable tools.

In addition, the sanding of other various materials is often necessary in various repairing and construction processes, the materials including wood, painted wood, fibre reinforced resin materials and plaster, all of which in many cases need to be sanded to provide a smooth finish or to remove undesired layers.

SUMMARY OF THE INVENTION

It is one object of the present invention, therefore, to provide a sanding tool which can be used for sanding various materials without the use of replacable sandpaper.

According to the invention, therefore, there is provided a sanding tool comprising a plurality of toothed strip portions, a set plastics filler material in which said strip portions are embedded so that the filler material rigidly supports the strip portions along their full length, and a support surface from which the teeth of the strips portions project for engaging and abrading a work surface generally parallel to the support surface, the strip portions being spaced from each other so as to sequentially engage the work surface as the support surface moves relative thereto and so as to allow self-cleaning from between the strip portions of material removed from the work surface by the strip portions.

The toothed strip portions embedded in the plastics material are preferably spaced by a wide distance which is significantly greater than the width of the strips themselves so that the self-cleaning effect is obtained.

Preferably the strip portions are formed from saw blade with a direction of cut longitudinal of the saw blade. In some cases the blades can be arranged side by side longitudinally of a rectangular body but in other cases a circular disc-type device can be provided with the blades arranged generally radial to the disc but with a curvature away from the radial direction.

Preferably the toothed strips which include saw-cut teeth are arranged to project upwardly from the support surface by a very small distance which can be less than the width of the shoulder, less than the spacing and preferably less than ⅛ inch. The surface also is preferably continuous and substantially imperforate so that it defines a backing plate which is rigid and protects the toothed strips or blades. This provides a rigid tool which avoids any possible gouging of the material and also channels the removed material toward the ends of the tool along between the toothed strips.

A tool of this type is apparently to the eye very much rougher than the 40 grade sandpaper which it replaces. However, surprisingly it can produce a very fine finish and can be used both on the material while it is setting and after setting. Use while the material is setting avoids the creation of dust and the heavier larger particles which are therefore removed tend merely to travel along the length of the tool along between the toothed strips.

The tool of this type can have a life of at least six months thus replacing large quantities of sandpaper.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
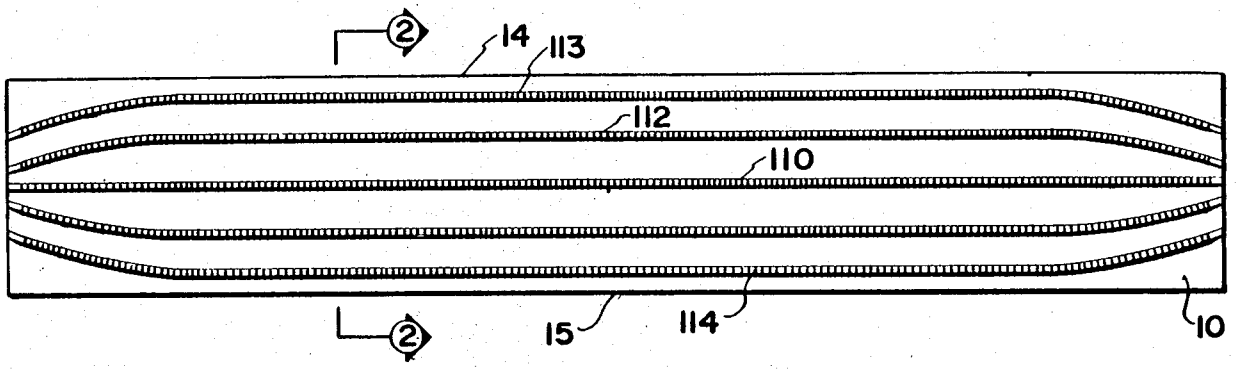
FIG. 1 is an underside plan view of a tool according to the invention.

The tool comprises a base plate 10 which has five elongate slots 11 along the length thereof. Sides 12 of the base plate are turned upwardly to define sidewalls and endwalls 13 are turned upwardly to define end flanges thus forming box section. For rigidity the sides 12 can be welded to the end plates 13 to form a completed box section.

Figure 2:
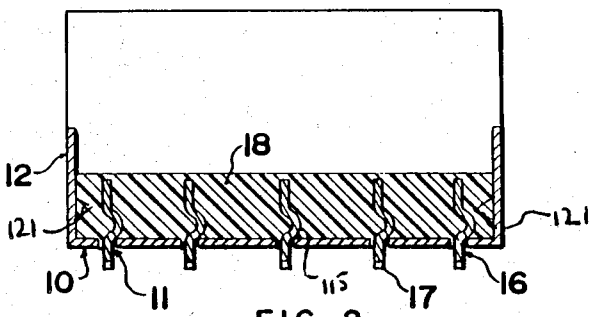
FIG. 2 is a cross-sectional view of the tool of FIG. 1 taken along the lines 2—2 thereof.
Figure 3:
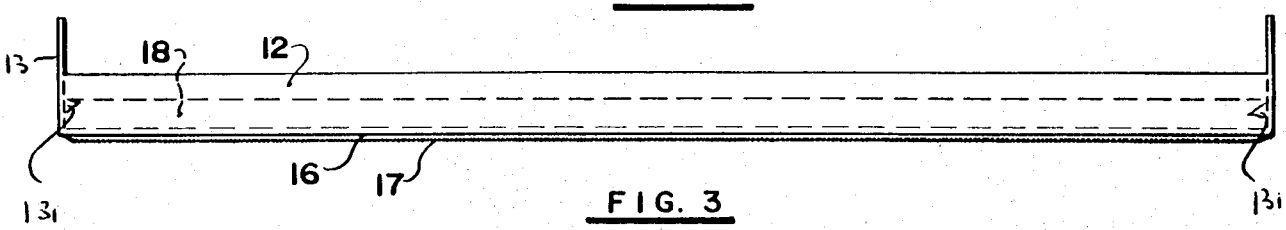
FIG. 3 is a side elevational view of the tool of FIG. 1.

Conveniently the box section can be manufactured by a stamping technique where the shape is cut from a blank simultaneously with the formation of the slots and subsequently the sides and ends are folded to form the box section as shown best in FIGS. 2 and 3.

The dimensions of the base plate are arranged to match the standard dimensions of a powered orbital sander so that in one example the base plate has width of the order of 3 inches and a length of the order of 16 inches. The side plates 12 and the end plates 13 are also shaped to cooperate with the attachment mechanism of the conventional powered sander and these can be shaped accordingly depending upon requirements.

The slots 11 extend along substantially the full length of the base plate with a central slot 110 which is substantially straight and along the center line of the base plate. On either side of the central line is provided a pair of further slots 112, 113 which are substantially equidistantly spaced so that the outer most slot is of the order of ¼ inch from the edge 14 of the base plate, the next spacing is ½ inch and the innermost spacing is ⅝ inch. These dimensions can of course be slightly modified in accordance with the requirements.

A toothed strip 16 is laid into each of the slots so that a toothed edge 17 of the toothed strip projects through the slot and extends outwardly from the base plate 10. The extent of projection is very small relative to the width of the tool and can be less than ⅛ inch. The toothed strips 16 can be formed from conventional hacksaw blades which have saw-cut teeth. As is well known saw-cut teeth have a direction of cut and a return direction and also are twisted outwardly to the sides to provide a cutting action. The blades can be of the order of 1/16 inch in width and thus are very narrow relative to the width of the tool. Alternatively, the blades can be formed without the side to side curvature of saw-cut blades. In addition, the blades include a control curved section 115 which helps to locate the blade relative to the plate 10.

Rearwardly of the base plate 10 that is on the side opposite the teeth 17, the toothed strips or blades are embedded in a resin material or other suitable setting rigid plastics material indicated at 18. The resin material is filled into the box section to a level just to cover the upstanding edges of the blades 16 so as to form a rigid support both for the base plate and for the blades. The sides 12 and the end plates 13 extend upwardly beyond the upper surface of the resin 18 to provide connection to the sander device as previously explained.

The sides and ends can include dimples 121, 131 to assist in interlocking the outer box structure and the resin layer 18.

Conveniently, the blades can be inserted into the base plate while the latter is resting over a suitable spacer including grease or other suitable material into which the blades can be pressed. The resin material can then be simply injected or poured onto the base plate up to the required level following which the base plate can be lifted from its support to complete the formation of the rigid tool.

The slots 11 curve inwardly at the ends of the tool so the spacing therebetween is reduced and the spacing between the outermost blade and the edge 14 is increased. This has a number of advantages in that firstly the blades can be positioned in the slots and can remain in position by the tension developed by their curvature in the slot. Secondly the inward curvature of the blades at the end of the tool defines an area which can be used for finer or smaller work. Thirdly the spacing between the outermost blade and the edge 14 is increased at the end to reduce the possibility of gouging as will be explained more hereinafter. The blades also extend all the way to the end of the plate 10.

The blades as shown in FIG. 1 are basically parallel bearing in mind the slight curvature inwardly at the ends. This defines a spacing between the blades which is substantially constant and which is very much greater than the width of the blade itself. In one example where the blade is 1/16 inch in width and the spacing between the blades is of the order of ½ inch, the spacing is 8 times greater than the width of the blade. In other examples or where the spacing is reduced, this ratio can be reduced to 5:1.

The height of the blade relative to the base plate 10 is very small relative to the width of the tool and to the spacing between the blades. A spacing of ⅛ inch can be used which provides a tooth height of the order of 1/16 inch and a height of blade portion between the surface 10 and the bottom of the teeth of the order of 1/16 inch. This dimension can of course be modified but it is chosen so as to avoid the possibility of the blades gouging the material and also to provide complete and rigid support for the blades to prevent their flexing and thus reducing the quality of the finish.

The teeth of the central blade 110 are directed in one direction, the teeth of the next adjacent outer blades arranged in the opposite direction and finally the outermost blades have their teeth in the same direction as the central blade and this assists in providing a smooth working action since the orbital movement provides some cutting in both directions.

In operation, prior to complete setting of the filler and at a time when sandpaper would otherwise quickly clog, the tool is applied to the filler to act as a rough initial shaper and then as a finer shaper thus replacing the conventional cheese grater and 40 grade sandpaper. In view of the fact that the filler can be worked upon while in the incompletely set condition, the work can proceed very much more quickly without the creation of dust. The wide spaces between the blades allow removed material to break away from the teeth and to run longitudinally of the tool between the blades to the ends where the material merely escapes. As it is in a softer or unset condition the particles can coagulate rather than create a fine cloud of dust. The tool if used skillfully can create a sufficiently smooth finish so that the conventional putty glaze is not required. This smooth finish can be obtained either by careful use of the tool while the filler material is still in the incompletely set condition or the tool can be reused at a later time when the material has been fully set to provide a final finishing effect.

The appearance of the tool is that it has a roughness very much greater than that of conventional sandpaper and that the widely spaced blades could do no more than roughly cut the material and provide gouges and channels in the filler material. Totally surprisingly and to the contrary, the tool can not only provide the initial rough shaping but also can provide a fine smoothing effect far greater than conventional 40 grade sandpaper.

While the device shown incorporates attachment plates for supporting the tool relative to the workface of a conventional powered orbital sander it will of course be appreciated that the tool could be manufactured with handles for manual operation or with modified attachment means for attachment to various other arrangements of powered sander or merely as a flat plate like object for manual grasping. In addition while the blades or toothed strips are shown to be substantially straight and longitudinal of the tool, they could be arranged in other configurations including circular arrangements.

The number of teeth per inch can vary to provide varying degrees of coarse or fine sanding effect.

In an alternative arrangement a circular disc type sander can be manufactured in a similar manner using toothed strips or blades arranged radially of the disc.

In a further alternative arrangement, the toothed strips can be embedded in a plastics material without any supporting base plate so that the surface of the plastics material provides the support surface from which the teeth protrude. A suitable plastics material can be Delron 100 (trade mark) from Dupont. Using this material a handle or clamping flange can be attached to the plastics body by screws into the end faces of the plate like plastics body.

Figure 4:
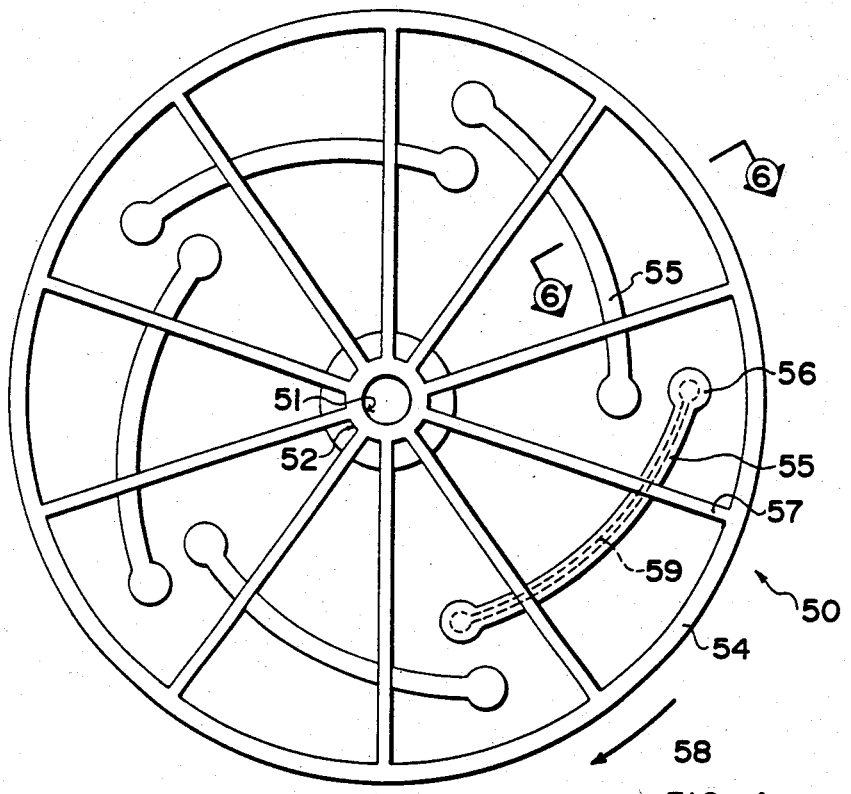
FIG. 4 is a plan view of a modified sanding tool according to the invention.
Figure 5:
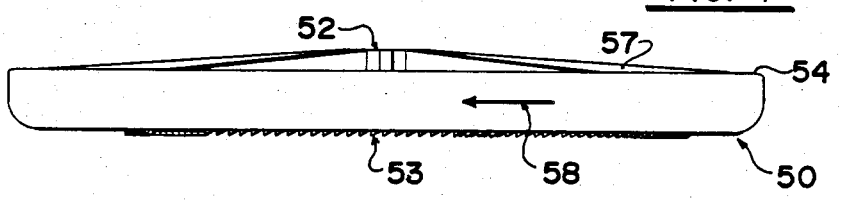
FIG 5. is an end elevational view of the sanding tool of FIG. 4.
Figure 6:
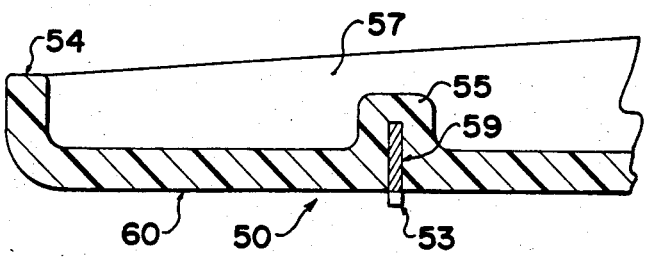
FIG. 6 is a cross-sectional view along the lines 6—6 of FIG. 4.

FIGS. 4, 5 and 6 show a modified sanding tool which is of a circular flat disc shape with the toothed strips arranged so that the teeth extend outwardly from one flat face of the disc. Thus, the disc is shown at 50 and includes a central bore 51 and recess 52 by which the disc can be attached to a suitable driven rotating device for example a drill or powered sander.

In this case the disc is substantially wholly formed from the plastics filler material without any supporting structures apart from the toothed strips or blades themselves which are generally indicated at 53.

The toothed strips or blades 53 are curved or bent and are relatively short in length so as to extend arcuately around approximately 70 degrees of the disc while moving outwardly on an increasing radius from a position closer the centre to a position adjacent the outer edge but spaced therefrom by a portion providing a shoulder.

The thickness of the disc 50 is generally less than the depth of the blade 53 so that ribs 55 are formed on the rear side of the disc into which the blades 53 extend, each blade having its own rib 55. The ribs 55 are formed with enlarged circular ends 56 to accommodate the ends of the blades to prevent cracking of the disc at the ends of the blades. An edge of the disc 54 is turned upwardly to the rear side and is connected to a plurality of radial stiffening ribs 57. Thus the ribs 57 and edge 54 provide rigidity for the disc while using a minimum of plastics in the formation of the disc.

The toothed strips or blades 53 have a direction of cut as a conventional saw blade which is arranged so that the blades cut as they are moved inwardly toward the center of the disc. Thus if the disc 50 is rotated in the direction of the arrow 58, each blade as it passes a particular point cuts from its inner most edge outwardly toward the outer edge so that material cut away from the work piece is moved outwardly from the blades towards the edge of the disc. The blades 53 thus stand outwardly from a planar smooth surface 60 on a working side of the disc. The dimensions of the blades relative to the surface 60, the edge 54 and to one another are as previously described in relation to the first embodiment to obtain a rigid tool with self-cleaning effect.

In manufacture of the disc, the plastics disc can be firstly molded from the preferred plastics Delron 100 (trade mark) with slots 59 for receiving the blades in a later step. The slots can have circular enlarged ends so that any movement of the blade relative to the plastics at the end caused by expansion or contraction does not cause cracking of the plastics. At the later step, the curved blades cut to the right length can be bonded into the slot by a bonding agent such as Caylite (trade mark).

In operation of the sanding disc of FIGS. 4, 5 and 6, it can be placed flat on a surface and driven in the stated direction. The self-cleaning effect obtained by the spacing of the blades and the rigidity of the disc allow the disc to cut cleanly and effectively over the full area of the disc without vibration or "walking"of the disc as occurs with conventional generally flexible sanding tools such as sanding discs or paper.

In a further arrangement (not shown) the toothed strip portions are provided by a single toothed strip or blade which is arranged in a spiral fashion so that one portion lies alongside a radially outer portion.

Since various modifications can be made in my invention as hereinabove described, any many apparently widely different embodiments of same made within the spirit and scope of the claims without departing from such spirit and scope, it is intended that all matter contained in the accompanying specification shall be interpreted as illustrative only and not in a limiting sense.

I claim:

1. Abrasive tool comprising a plurality of toothed strip portions, and integral continuous imperforate body member formed from a set plastics filler material in which said strip portions are rigidly embedded so that the filler material rigidly supports the strip portions along their full length, said body member being shaped to define an intended direction of working movement, said body member defining a support surface from which the teeth of the strip portions project for engaging and abrading a work surface generally parallel to the support surface, the strip portions being spaced from each other along their full length by a distance at least five times greater than the width thereof so as to sequentially engage the work surface as the support surface moves relative thereto and so as to allow self-cleaning from between the strip portions of material removed from the work surface by the strip portions, each said strip member being curved along its length in a curvature different from the intended direction of movement of the body member such it is prevented from moving in a working stroke of said body member directly along its length, said support surface having side edges which project sidewardly from outermost portions of the toothed strip portions so as to define shoulders, the extent of projection of the outermost portions from the surface being less than the width of the shoulder whereby to inhibit gouging of the work surface by the outermost toothed strip portions, the extent of projection of the toothed strip portions from said surface being less than $\frac{1}{8}$ inch.

2. A tool according to claim 1 wherein the filler material is shaped to form a flat circular disc with the teeth projecting from one flat surface of said disc, each strip portion extending in a curved direction outwardly and rearwardly relative to a direction of rotation of the disc, said teeth being saw-cut teeth having a direction of cut longitudinally of the strip portion and forwardly and inwardly of the disc.

* * * * *